United States Patent [19]

Katoh et al.

[11] Patent Number: 4,528,961

[45] Date of Patent: Jul. 16, 1985

[54] METHOD OF AND SYSTEM FOR LEAN-CONTROLLING AIR-FUEL RATIO IN ELECTRONICALLY CONTROLLED ENGINE

[75] Inventors: Kenji Katoh, Nagaizumi; Yoshiki Chujo, Susono, both of Japan

[73] Assignee: Toyota Jidosha Kabushiki Kaisha, Toyota, Japan

[21] Appl. No.: 566,420

[22] Filed: Dec. 28, 1983

[30] Foreign Application Priority Data

May 12, 1983 [JP] Japan ..... 58-83317

[51] Int. Cl.[3] ..... F02M 51/00

[52] U.S. Cl. ..... 123/489; 123/480; 123/491

[58] Field of Search ..... 123/489, 480, 491, 339

[56] References Cited

U.S. PATENT DOCUMENTS 4,356,065 10/1982 Dietz ..... 123/489
4,373,187 2/1983 Ishii et al. ..... 123/489
4,392,471 7/1983 Miyagi et al. ..... 123/480
4,398,514 8/1983 Nakamura ..... 123/339
4,416,237 11/1983 Aoki et al. ..... 123/480

FOREIGN PATENT DOCUMENTS 0035238 3/1983 Japan ..... 123/489

*Primary Examiner*—Parshotam S. Lall
*Attorney, Agent, or Firm*—Cushman, Darby & Cushman

[57] ABSTRACT

In a method of and system for lean-controlling an air-fuel ratio in an electronically controlled engine, wherein the air-fuel ratio is feedback-controlled to the lean side from the stoichiometric air-fuel ratio in accordance with an output from a lean sensor generating an output signal substantially proportional to the concentration of oxygen in the exhaust gas, when it is necessary to vary a target air-fuel ratio, a target control value of an output from the lean sensor is corrected in accordance with the required variation value and the air-fuel ratio is feedback-controlled whereby the output from the lean sensor can become the corrected target control value, so that satisfactory feedback control of the air-fuel ratio can be effected even when the target air-fuel ratio is varied to a value other than the normal value.

8 Claims, 16 Drawing Figures

METHOD OF AND SYSTEM FOR LEAN-CONTROLLING AIR-FUEL RATIO IN ELECTRONICALLY CONTROLLED ENGINE

BACKGROUND OF THE INVENTION

1. Field of the Invention

This invention relates to method of and system for lean-controlling an air-fuel ratio in an electronically controlled engine, and more paticularly to improvements in method of and system for lean-controlling an air-fuel ratio in an electronically controlled engine, suitable for use in an engine for a motor vehicle, provided with an electronically controlled fuel injection device, wherein an air-fuel ratio is feedback-controlled to the lean side form the stoichiometric air-fuel ratio in response to an output from a lean sensor generating an output signal substantially proportional to the concentration of oxygen in the exhaust gas.

2. Description of the Prior Art

In an internal combustion engine, particularly, in an engine for a motor vehicle, provided with an emission control measure by use of a three-way catalyst, it is necessary to strictly hold an air-fuel ratio of the exhaust gas (hereinafter referred to as the "exhaust air-fuel ratio") flowing through the catalyst to the vicinity of the stoichiometric air-fuel ratio. In view of this, there has been put into practical use a method of feedback-controlling an air-fuel ratio to the stoichiometric air-fuel ratio in response to a rich or lean signal outputted from an oxygen concentration sensor (hereinafter referred to as an "$O_2$ sensor") generating a voltage in ON-OFF manner in accordance with a rich or lean condition of the exhaust air-fuel ratio with respect to the stoichiometric air-fuel ratio sensed from the concentration of oxygen in the exhaust gas. The above-described method of controlling a air-fuel ratio features that the air-fuel ratio can be feedback-controlled to the vicinity of the stoichiometric air-fuel ratio, so that the exhaust gas purifying performance by the three-way catalyst provided in an exhaust system can be satisfactorily improved. However, since the air-fuel ratio is constantly controlled to the vicinity of the stoichiometric air-fuel ratio in the above-described method of controlling the air-fuel ratio, the stoichiometric air-fuel ratio is maintained even in the operating condition where an air-fuel ratio to the lean side from the stoichiometric air-fuel ratio (hereinafter referred to as a "lean air-fuel ratio") is practically adoptable, such as in a light engine load region, whereby there have been some cases where the fuel consumption performance cannot be satisfactorily improved.

To obviate the above-described disadvantage, there has heretofore been attempted that the air-fuel ratio is brought to the lean side from the stoichiometric air-fuel ratio to effect a so-called lean combustion, so that the fuel consumption performance of the engine can be improved. This air-fuel ratio lean control method utilizes such a fact that a good correlation is observed between the concentration of oxygen in the exhaust gas and the air-fuel ratio when the lean air-fuel ratio is adopted, so that the air-fuel ratio in the exhaust gas can be continuously detected by measuring the concentration of oxygen in the exhaust gas.

As shown in FIG. 1, one of the sensors capable of measuring the concentration of oxygen in the exhaust gas and generating an output signal substantially proportional to the concentration of of oxygen (hereinafter referred to as a "lean sensor") includes:

a bottomed cylinder-shaped element body 10A made of an oxygen ion conductive, stabilized zirconia solid electrolyte;

an air-permeable measuring electrode (cathode) 10B provided on the outer surface of the element body 10A, made of a heat-resistant, electronically conductive body such as platinum and capable of introducing the exhaust gas as being the gas to be measured;

a diffusion-resistant layer 10C provided to coat the cathode 10B and formed into a porous ceramic material made of a heat-resistant inorganic substance such as alumina, magnesia or spinel for controlling the diffusion of the concentration of oxygen in the exhaust gas;

an air-permeable electrode (anode) 10D provided on the inner surface of the element body 10A, made of a heat-resistant, electronically conductive body such as platinum and capable of introducting atmosphere having a known concentration of oxyen (about 21%);

an atmosphere intake pipe 10E for taking in atmosphere along the anode 10D; and a heater 10F provided in a gap of the atmosphere intake pipe 10E in such a manner that the forward end thereof approaches the bottom portion of the element body 10A, for heating the forward end portion (the bottom portion) of the element body 10A to a predetermined temperature, e.g., 650°–700° C. or more so as to make the element body 10A to function as an oxygen pump.

If current is passed between the aforesaid electrodes 10B and 10D in the above-described lean sensor 10, then oxygen can be moved in one direction through the electrolyte. However, the cathode 10B is coated by the diffusion-resistant layer 10C having pores for sending in oxygen smaller in value than an oxygen delivering capacity of the cathode 10B, so that the value of current can be held at a predetermined one in some applied voltage region. This predetermined current value is a so-called threshold current value. This threshold current value is varied substantially rectilinearly in proportion to the concentration of oxygen, so that, for example, the concentration of oxygen can be continuously detected from a variation in an output voltage from the lean sensor in which the threshold current value is converted to a voltage signal.

The air-fuel ratio lean control using the aforesaid lean sensor features that the air-fuel ratio can be feedback-controlled to the lean side from the stoichiometric air-fuel ratio. However, heretofore, when it is desired to make the air-fuel ratio different from a target air-fuel ratio (hereinafter referred to a "base air-fuel ratio") during normal operation condition in both the aforesaid control of the air-fuel ratio using an $O_2$ sensor and the aforesaid air-fuel ratio lean control using the lean sensor, as in a warm-up fuel amount increase effected depending on an engine cooling water temperature, etc. during cold engine state for example and it is desired to vary the target air-fuel ratio to the rich side from the normal target air-fuel ratio, the feedback control has not been able to continue, and consequently, the feedback control has been stopped and an open-loop control has been adopted. In consequence, when the fuel amount increase or decrease has become necessary as described above, there has been presented such a disadvantage that fluctuations and dispersion in the air-fuel ratio cannot be corrected. Particularly, the air-fuel ratio lean control using the lean sensor has presented the disadvantages that the air-fuel ratio reaches an overlean extent exceeding the limit of misfire, thus deteriorating the operating performance, or the air-fuel ratio is brought to the rich side from the base air-fuel ratio, whereby the air-fuel ratio is brought into between the base air-fuel ratio and the stoichiometric air-fuel ratio, thus deteriorating the exhaust gas purifying performance and the fuel consumption performance.

SUMMARY OF THE INVENTION

The present invention has developed to obviate the above-described disadvantages of the prior art and has as its first object the provision of a method of lean-controlling an air-fuel ratio in an electronically controlled engine, wherein the feedback-control can be effected even when the target air-fuel ratio is made to be one different from the base air-fuel ratio, so that highly accurate air-fuel ratio control can be effected irrespective of the operating condition of the engine.

The present invention has as its second object the provision of a method of lean-controlling an air-fuel ratio in an electronically controlled engine, wherein fluctuation and dispersion in an air-fuel ratio can be avoided at the time of warm-up fuel amount increase during cold engine state.

The present invention has as its third object the provision of a method of lean-controlling an air-fuel ratio in an electronically controlled engine, wherein the cold engine state can be readily examined.

The present invention has as its fourth object the provision of a method of lean-controlling an air-fuel ratio in an electronically controlled engine, wherein fluctuations and dispersion in an air-fuel ratio can be avoided at the time of fuel amount increase in a high engine load region.

The present invention has as its fifth object the provision of a method of lean-controlling an air-fuel ratio in an electronically controlled engine, wherein the high engine load region can be readily examined.

The present invention has as its sixth object the provision of a method of lean-controlling an air-fuel ratio in an electronically controlled engine, wherein accurate air-fuel ratio control can be effected in accordance with output characteristics of a lean sensor.

The present invention has as its seventh object the provision of a method of lean-controlling an air-fuel ratio in an electronically controlled engine, wherein the reliability is improved.

The present invention has as its eighth object the provision of a system for lean-controlling an air-fuel ratio in an electronically controlled engine, wherein the first and second object are achieved.

The present invention has as its ninth object the provision of a system for lean-controlling an air-fuel ratio in an electronically controlled engine, wherein a lean sensor suitable for achieving the objects of the present invention is adopted.

The present invention has as its tenth object the provision of a system for lean-controlling an air-fuel ratio in an electronically controlled engine, wherein the first and fourth objects are achieved.

To achieve the aforesaid first object, the present invention contemplates that, in the method of lean-controlling an air-fuel ratio in an electronically controlled engine, wherein the air-fuel ratio is feedback-controlled to the lean side from the stoichiometric air-fuel ratio in accordance with an output from a lean sensor generating an output signal substantially proportional to the concentration of oxygen in exhaust gas, wherein the aforesaid method, as the gist thereof is shown in FIG. 2, includes:

a step of determining a target control value of an output from the lean sensor corresponding to a base air-fuel ratio which is a target air-fuel ratio during normal engine operating condition, in accordance with the engine operating condition;

a step of examining whether the target air-fuel ratio is required to be varied or not, in accordance with the engine operating condition;

a step of correcting the aforesaid target control value in accordance with a variation value when the target air-fuel ratio is required to be varied; and a step of feedback-controlling the air-fuel ratio so that the output from the lean sensor can become the target control value.

To achieve the aforesaid second object, the present invention contemplates that the aforesaid target control value is corrected when the target air-fuel ratio is varied to the rich side from the base air-fuel ratio in accordance with the temperature of engine cooling water in a cold engine state.

To achieve the aforesaid third object, the present invention contemplates that the aforesaid cold engine state is determined from that the temperature of engine coolant is below a preset value.

To achieve the aforesaid fourth object, the present invention contemplates that the aforesaid target control value is corrected when the target air-fuel ratio is gradually varied to the rich side from the base air-fuel ratio in accordance with the throttle opening in a high engine load region.

To achieve the aforesaid fifth object, the present invention contemplates that the high engine load region is determined from that the throttle opening is above a preset value.

To achieve the aforesaid sixth object, the present invention contemplates that the feedback control of the air-fuel ratio based on the target control value after the aforesaid correction is effected only on the lean side from the stoichiometric air-fuel ratio.

To achieve the aforesaid seventh object, the present invention contemplates that the aforesaid feedback control is not effected before the completion of warm-up of the lean sensor.

To achieve the aforesaid eighth object, the present invention contemplates that the air-fuel ratio lean control system in the electronically controlled engine, comprises:

a pressure sensor for detecting intake air pressure;

an injector or injectors for intermittently injecting pressurized fuel into the engine;

a lean sensor for generating an output voltage substantially proportional to the concentration of oxygen in the exhaust gas;

a crank angle sensor for detecting a crank angle of the engine;

a coolant temperature sensor for detecting the temperature of engine coolant; and an electronic control unit for calculating a basic injection pulse width in accordance with an engine load detected from intake pipe pressure outputted from the pressure sensor and an engine speed obtained from the crank angle sensor, determining an executing injection pulse width by correcting the basic injection pulse width in accordance with at least outputs from the lean sensor and the coolant temperature sensor, feeding a valve opening period signal to the injector or injectors so that the injector or injectors can be intermittently opened for a valve opening period corresponding to the executing injection pulse width, feedback-controlling the air-fuel ratio so that the output from the lean sensor can become the target control value corresponding to the base air-fuel ratio during normal engine operating condition when the basic injection pulse width is corrected in accordance with the output from the lean sensor, and, feedback-controlling the air-fuel ratio so that the output from the lean sensor can become the target control value corrected to the rich side in accordance with the temperature of engine coolant in the cold engine state.

To achieve the aforesaid ninth object, the present invention contemplates that the lean sensor includes:

a bottomed cylinder-shaped element body made of an oxygen ion conductive, stabilized zirconia solid electrolyte;

an air-permeable cathode provided on the outer surface of the element body, made of a heat-resistant, electronically conductibe body and capable of introducing the exhaust gas;

a diffusion-resistant layer provided to coat the cathode and formed into a porous ceramic material made of a heat-resistant inorganic substance for controlling the diffusion of the concentration of oxygen in the exhaust gas;

an air-permeable anode provided on the inner surface of the element body, made of a heat-resistant, electronically conductive body and capable of introducing atmosphere;

an atmosphere intake pipe for taking in atmosphere along the anode; and a heater provided in a gap of the atmosphere intake pipe in such a manner that the forward end thereof approaches the bottom portion of the element body, for heating the forward end portion of the element body to a predetermined temperature so as to make the element body to function as an oxygen pump.

To achieve the aforesaid tenth object, the present invention contamplates that the air-fuel ratio lean control device in the electronically controlled engine includes:

a throttle sensor for detecting the opening of a throttle valve;

a pressure sensor for detecting intake air pressure;

an injector or injectors for intermittently injecting pressurized fuel into the engine;

a lean sensor for generating an output voltage substantially proportional to the concentration of oxygen in the exhaust gas;

a crank angle sensor for detecting a crank angle of the engine; and an electronic control unit for calculating a basic injection pulse width in accordance with an engine load detected from an intake pipe pressure outputted from the pressure sensor and an engine speed obtained from the crank angle sensor, determining an executing injection pulse width by correcting the basic injection pulse width in accordance with at least outputs from the throttle sensor and the lean sensor, feeding a valve opening period signal to the injector or injectors so that the injector or injectors can be intermittently opened for a valve opening period corresponding to the executing injection pulse width, feedback-controlling the air-fuel ratio so that the output from the lean sensor can become the target control value corresponding to the base air-fuel ratio during normal engine operating condition when the basic injection pulse width is corrected in accordance with the output from the lean sensor, and feedback-controlling the air-fuel ratio so that the output from the lean sensor can become the target control value gradually corrected to the rich side in accordance with the throttle opening in the high engine load region.

Description will hereunder be given of the principle of the present invention.

FIG. 3 shows one example of the output characteristics of the lean sensor 10 shown previously in FIG. 1. Now, if fuel is increased in amount by an increase rate $\alpha$ from the base air-fuel ratio set to the lean side from the stoichiometric air-fuel ratio to thereby reach the stoichiometric air-fuel ratio, then an output voltage from the lean sensor 10 is varied from $V_{base}$ to $V_{\alpha}$. In consequence, the relationship between the increase rate $\alpha$ and a correction factor of the target control voltage outputted from the lean sensor is sought as shown in FIG. 4. Therefore, in order to vary the feedback air-fuel ratio from the base air-fuel ratio to the stoichiometric air-fuel ratio, the target control voltage outputted from the lean sensor should be corrected from $V_{base}$ to $V_{\alpha}$. The present invention is based on this principle. When it is necessary to vary the target air-fuel ratio, the target control value is corrected in accordance with the value of a variation and the air-fuel ratio is feedback-controlled so that an output from the lean sensor can become the target control value after the correction, whereby, even when the target air-fuel ratio is different from the base air-fuel ratio, the feedback control of the air-fuel ratio can be satisfactorily effected.

According to the present invention, even when the target air-fuel ratio is changed to a value other than the base air-fuel ratio which is the target air-fuel ratio during normal engine operating condition, the feedback control of the air-fuel ratio can be satisfactorily effected, and, irrespective of the engine operating condition, highly accurate air-fuel ratio control can be effected. In consequence, fluctuations in the air-fuel ratio, dispersions in the fuel flowrate and the like due to the deteriorated components can be corrected, whereby misfire is prevented, so that the drivablity, exhaust gas purifying performance, fuel consumption performance and the like can be improved.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the intake pipe pressure sensing type electronically controlled fuel injection device in an engine for a motor vehicle, to which is applied the method of lean-controlling the air-fuel ratio in the electronically controlled engine according to the present invention, with reference to the drawings.

Figure 1:
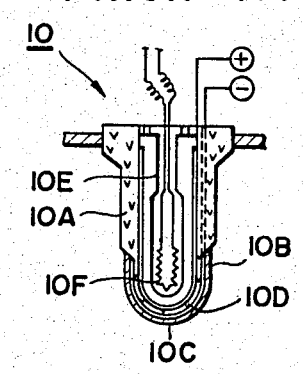
FIG. 1 PRIOR ART
FIG. 1 is a sectional view showing the arrangement of the lean sensor used in the conventional air-fuel ratio lean control.
Figure 2:
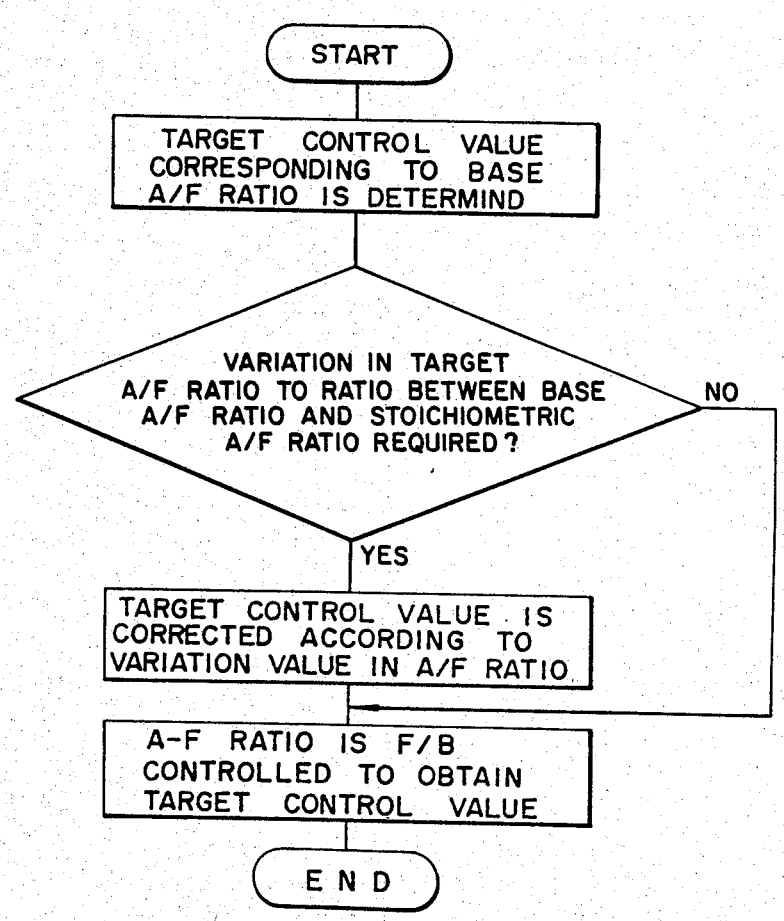
FIG. 2 is a flow chart showing the gist of the method of lean-controlling the air-fuel ratio in an electronically controlled engine according to the present invention.
Figure 3:
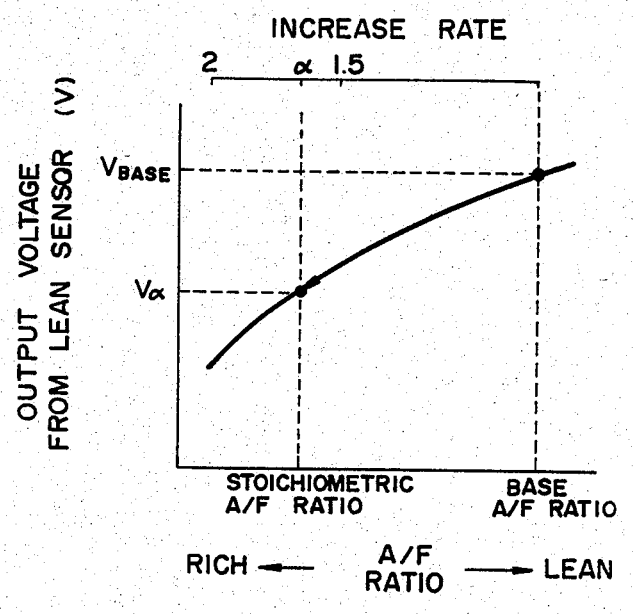
FIG. 3 is a graphic chart showing the relationship between the air-fuel ratio, the increase rate of fuel amount corresponding to the air-fuel ratio and output voltages from the lean sensor in explanation of the principle of the present invention.
Figure 4:
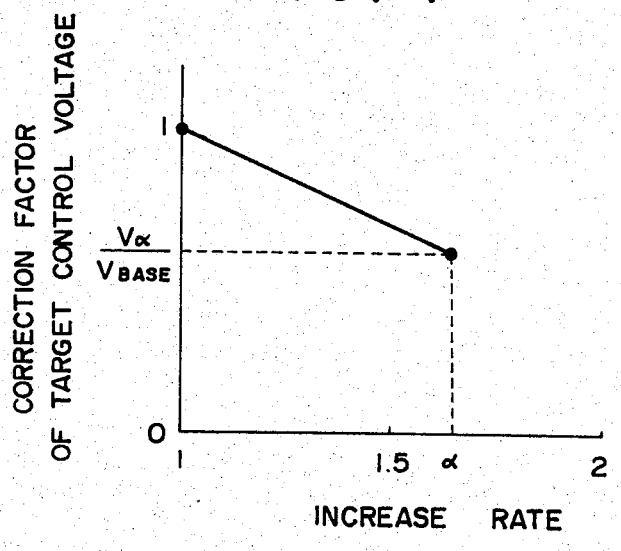
FIG. 4 is a graphic chart showing an example of the relationship between the increase rate of fuel amount and the correction factor of the target control voltage outputted from the lean sensor in explanation of the principle of the present invention.
Figure 5:
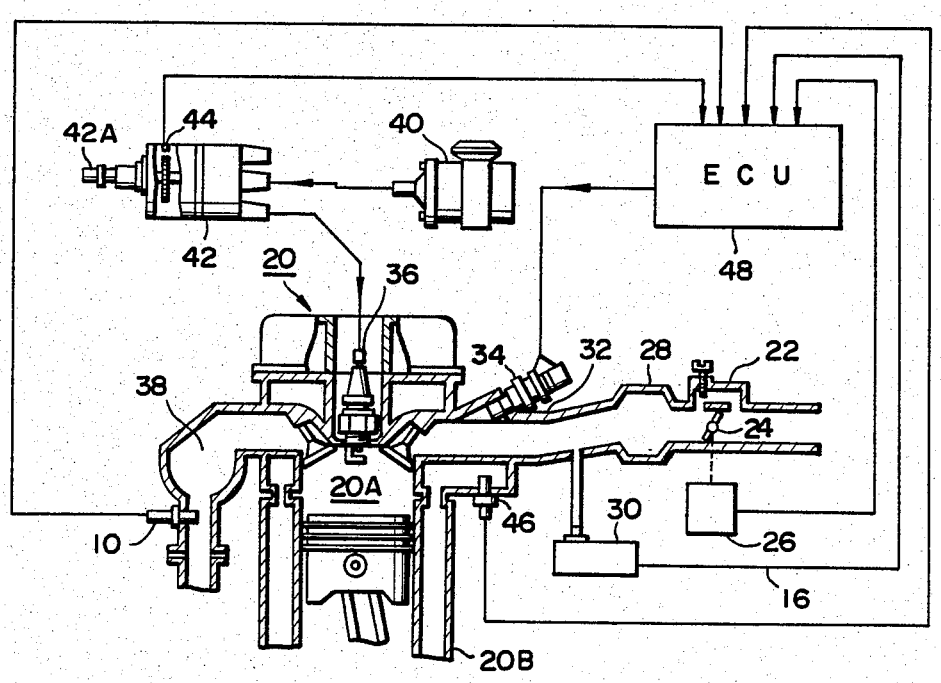
FIG. 5 is a sectional view, partially including a block diagram, showing the general arrangement of a first embodiment of an intake pipe pressure sensing type electronically controlled fuel injection device in an engine for a motor vehicle, to which the present invention is applied.

As shown in FIG. 5, the first embodiment of the present invention includes:

a throttle valve 24 provided on a throttle body 22 and adapted to be opened or closed in operational association with an accelerator pedal, not shown, provided at a driver's seat, for controlling the flowrate of intake air;

a throttle sensor 26 for detecting the opening of the throttle valve 24;

a surge tank 28 for preventing the interference with the air intake;

a pressure sensor 30 for detecting intake air pressure at the downstream side of the surge tank 28;

injectors 34 provided on an intake manifold 32, for intermittently injecting pressureized fuel toward intake ports of respective cylinders of an engine 20;

spark plugs 36 for igniting an air-fuel mixture taken into engine combustion chambers 20A;

a lean sensor 10 provided at the downstream side of an exhaust manifold 38 and having the arrangement shown in FIG. 1, for generating an output voltage substantially proportional to the concentration of oxygen in the exhaust gas;

a distributor 42 having a distributor shaft 42A rotatable in association with the rotation of a crank shaft of the engine 20, for distributing an igniting secondary signal of high voltage to the spark plugs 36 of the respective cylinders;

a crank angle sensor 44 incorporated in the distributor 42, for detecting a crank angle of the engine 20 from the rotating condition of the distributor shaft 42A;

a water temperature sensor 46 provided on a cylinder block 20B of the engine 20, for detecting the temperature of engine cooling water; and an electronic control unit (hereinafter referred to as an "ECU") 48 for calculating a basic injection pulse width $TAU_{base}$ in accordance with an engine load detected from an intake pipe pressure outputted from the pressure sensor 30 and an engine speed obtained from the crank angle sensor 44, determining an executing injection pulse width TAU by correcting the basic injection pulse width $TAU_{base}$ in accordance with outputs from the throttle sensor 26, the lean sensor 10, the water temperature sensor 46 and the like, and outputting a valve opening period signal to injectors 34 so that the injectors 34 can be intermittently opened for a valve opening period corresponding to the executing injection pulse width TAU.

Figure 6:
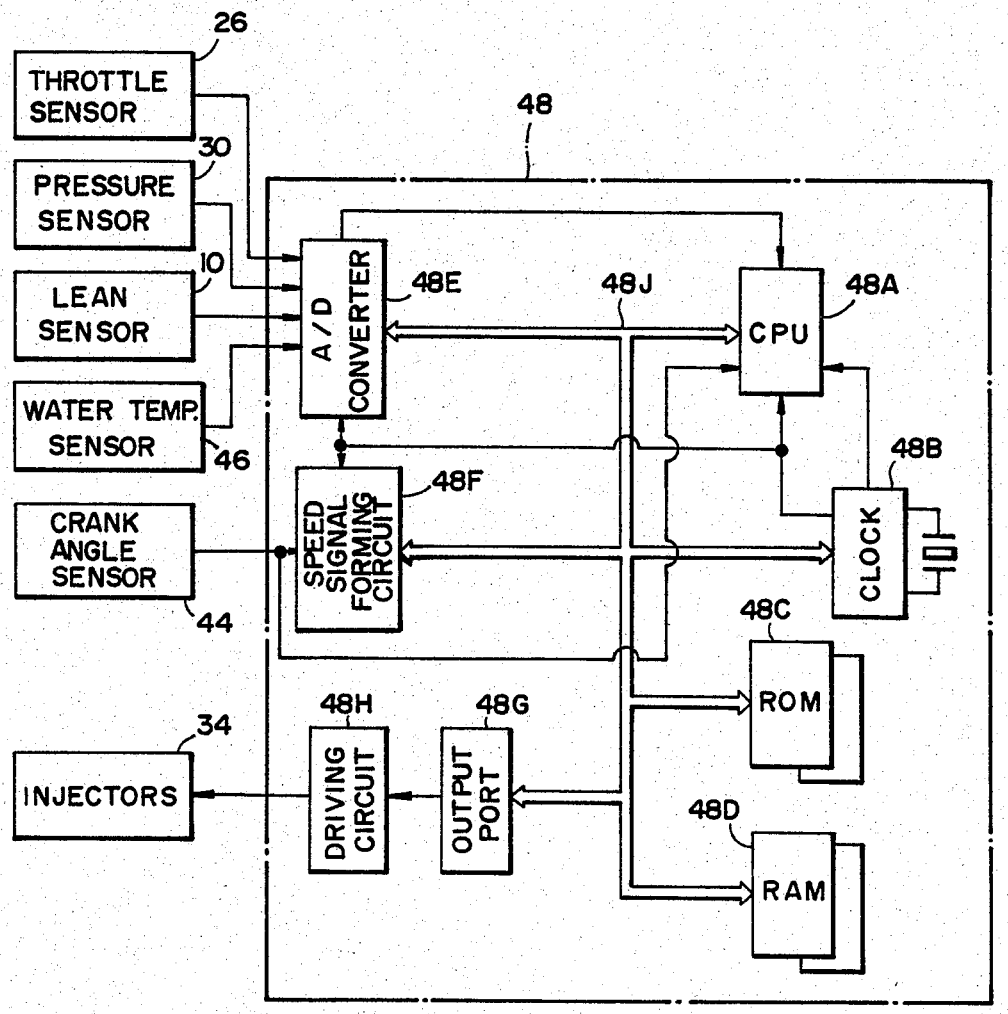
FIG. 6 is a block diagram showing the arrangement of the electronic control unit used in the first embodiment.

As detailedly shown in FIG. 6, the ECU 48 includes:

a central processing unit (hereinafter referred to as a "CPU") 48A consisting of a microprocessor for example, for conducting various calculations and processings;

a clock generating circuit 48B for generating various clock signals;

a Read Only Memory (hereinafter referred to as a "ROM") 48C for storing control programs, various data and the like;

a Random Access Memory (hereinafter referred to as a "RAM") 48D for temporarily storing operational data in the CPU 48A and the like;

an analogue/digital converter (hereinafter referred to as an "A/D converter") 48E having a multiplexer function, for converting analogue signals inputted from the throttle sensor 26, the pressure sensor 30, the lean sensor 10, the water temerature sensor 46 and the like into digital signals and successively taking the same in;

a speed signal forming circuit 48F for forming a speed signal representing a rotational speed of the engine 20 from an output of the crank angle sensor 44, an output port 48G for outputting a valve opening period signal to the injectors 34 through a drive circuit 48H in accordance with the result of calculation of the CPU 48A; and a common bus 48J connecting the the aforesaid components to one another to transfer data and commands.

Description will now be given of action.

Figure 7:
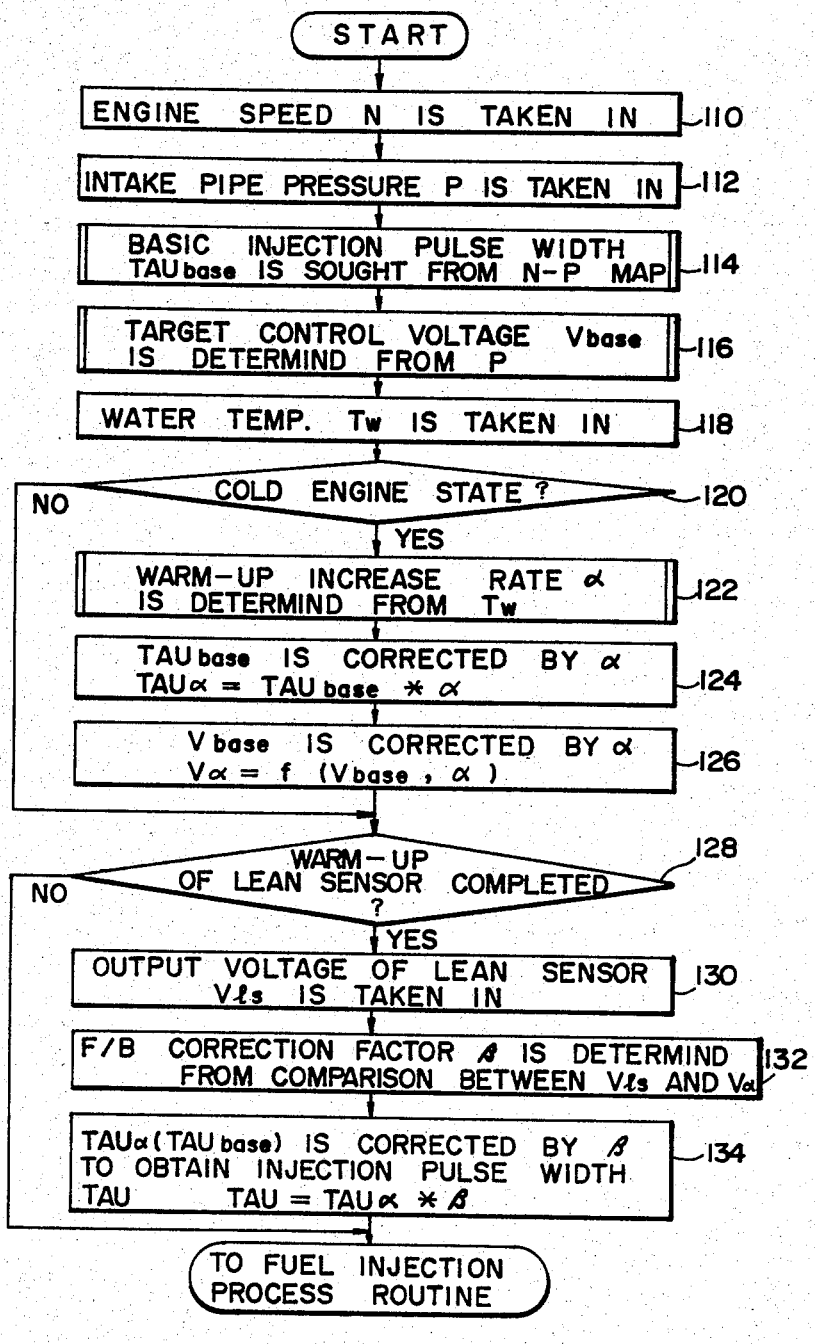
FIG. 7 is a flow chart showing the routine for determining the executing injection pulse width used in the first embodiment.
Figure 8:
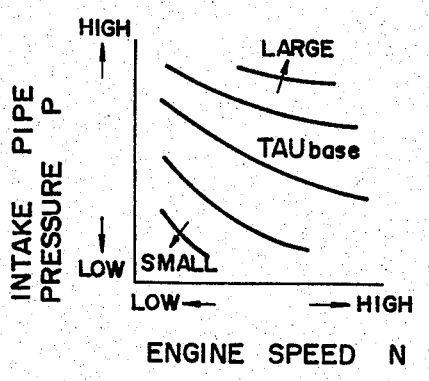
FIG. 8 is a graphic chart showing an example of the relationship between the engine speed, intake pipe pressure and the basic injection pulse width used in the routine as shown in FIG. 7.
Figure 9:
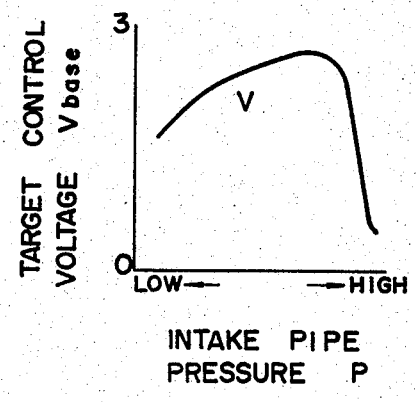
FIG. 9 is a graphic chart showing an example of the relationship between the intake pipe pressure and the target control voltage used in the routine as shown in FIG. 7.
Figure 10:
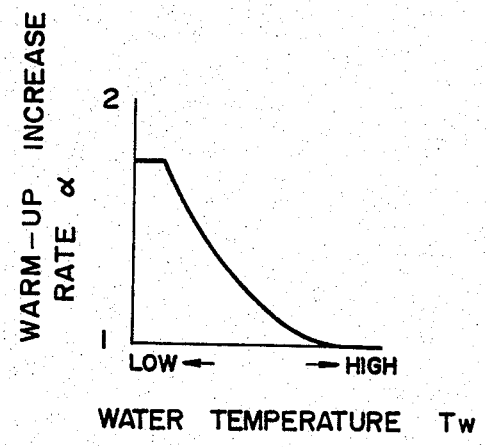
FIG. 10 is a graphic chart showing an example of the relationship between the temperature of engine cooling water and the warm-up increase rate of fuel amount used in the routine as shown in FIG. 7.

The executing injection pulse width TAU in this embodiment is determined according to the flow chart shown in FIG. 7. More specifically, firstly, in Step 110, an engine speed N formed in the aforesaid speed signal forming circuit 48F is taken in. Subsequently, the routine proceeds to Step 112, where an intake pipe pressure P is taken in in accordance with an output from the pressure sensor 30. Then, the routine proceeds to Step 114, where the basic injection pulse width $TAU_{base}$ is sought from a map representing the relationship between the engine speed N, intake pipe pressure P and the basic injection pulse width $TAU_{base}$ as shown in FIG. 8 for example (hereinafter referred to as a "$TAU_{base}$ map") which is stored in the ROM 48C, in accordance with the engine speed N and the intake pipe pressure P. Subsequently, the routine proceeds to Step 116, where the target control voltage $V_{base}$ is sought from a table representing the relationship between the intake pipe pressure P and the target control voltage $V_{base}$ outputted from the lean sensor 10, which corresponds to the base air-fuel ratio, as shown in FIG. 9 for example (hereinafter referred to as a "$V_{base}$ table") which is stored in the ROM 48C, in accordance with the intake pipe pressure P. Then, the routine proceeds to Step 118, where the temperature of engine cooling water $T_w$ is taken in in accordance with an output from the water temperature sensor 46. Subsequently, the routine proceeds to Step 120, where it is examined whether the cold engine state is present or not, from whether the temperature of engine cooling water $T_w$ is below a preset value or not. When the result of examination is positive, namely, it is judged that it is necessaty to conduct the warm-up fuel amount increase, the routine proceeds to Step 122, where the warm-up increase rate of fuel amount $\alpha$($\alpha$=1.0–2.0 or thereabout) is sought from a table representing the relationship between the temperature of engine cooling water $T_w$ and the warm-up increase rate $\alpha$ as shown in FIG. 10 for example, which is stored in the ROM 48C, in accordance with the temperature of engine cooling water $T_w$. Then, the routine proceeds to Step 124, where the basic injection pulse width $TAU_{base}$ is corrected by use of the warm-up increase rate $\alpha$ obtained and in accordance with the following equation for example to determine the corrected injection pulse width $TAU_\alpha$.

$$TAU_\alpha = TAU_{base} \times \alpha \quad (1)$$

Figure 11:
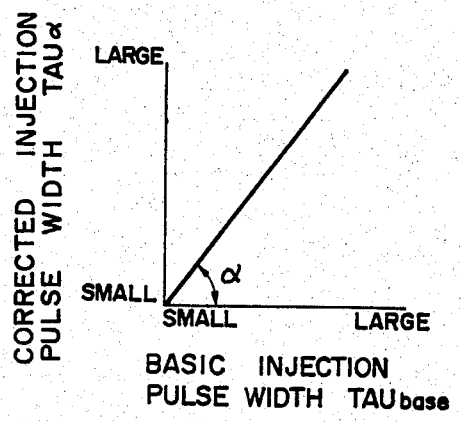
FIG. 11 is a graphic chart showing an example of the relationship between the basic injection pulse width and the corrected injection pulse width in the first embodiment.

In consequence, the relationshop between the basic injection pulse width $TAU_{base}$ and the corrected injection pulse width $TAU_\alpha$ is like the one shown in FIG. 11.

Subsequently, the routine proceeds to Step 126, where the target control voltage $V_{base}$ is corrected by use of the warm-up increase rate $\alpha$ and in accordance with the relationship shown in the following equation for example, to determine the corrected target voltage $V_\alpha$.

$$V_\alpha = f(V_{base}, \alpha) \quad (2)$$

Figure 12:
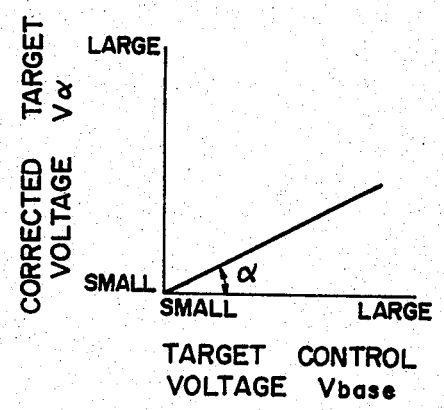
FIG. 12 is a graphic chart showing an example of the relationship between the target control voltage and the corrected target control voltage in the first embodiment.

FIG. 12 shows an example of the relationship between the target control voltage $V_{base}$ and the corrected target voltage $V_\alpha$.

Upon completion of Step 126 or when the result of examination in the aforesaid Step 120 is negative and it is judged that the hot engine state after the completion of the warm-up is present, the routine proceeds to Step 128, where it is examined whether the warm-up of the lean sensor 10 is completed or not, from whether the temperature of the lean sensor 10 is above the preset temperature or not, for example. Subsequently, the routine proceeds to Step 130, where an output voltage $V_{Is}$ from the lean sensor 10 is taken in. Then, the routine proceeds to Step 132, where the output voltage $V_{Is}$ from the lean sensor 10 is compared with the corrected target voltage $V_\alpha$(in the cold engine state) obtained in the aforesaid Step 126 or the target control voltage $V_{base}$ (in the hot engine state) obtained in the aforesaid Step 116, to determine a feedback correction factor $\beta$ (in the case of the base air-fuel ratio being 1.0) for correcting the corrected injection pulse width $TAU_\alpha$. Subsequently, the routine proceeds to Step 134, where the corrected injection pulse width $TAU_\alpha$(in the cold engine state) obtained in the aforesaid Step 124 or the basic injection pulse width $TAU_{base}$ (in the hot engine state) obtained in the aforesaid Step 114 is corrected by use of the feedback correction factor $\beta$ and in accordance with the following equation for example, to determine the executing injection pulse width TAU.

$$TAU = TAU_\alpha(TAU_{base}) \times \beta \quad (3)$$

Figure 13:
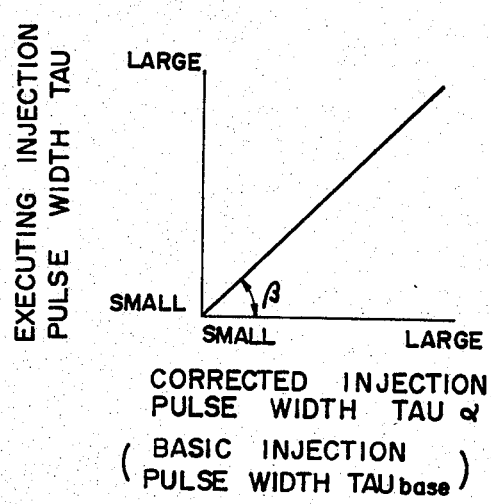
FIG. 13 is a graphic chart showing an example of the relationship between the corrected injection pulse width and the executing injection pulse width in the first embodiment.

FIG. 13 shows an example of the relationship between the corrected injection pusle width $TAU_\alpha$or the basic injection pulse width $TAU_{base}$ and the executing injection pulse width TAU.

Upon completion of Step 134 or when the result of examination in the aforesaid Step 128 is negative, this routine is passed through, and transfer is made to a known fuel injection process routine, where the fuel injection according to the executing injection pulse width TAU is executed. Here, the reason why the feedback control is not effected when the result of examination in the aforesaid Step 128 is negative, namely, before the completion of warm-up of the lean sensor 10, is that the reliability of an output from the lean sensor 10 is low before the completion of warm-up of the lean sensor 10.

In this embodiment, the air-fuel ratio can be feedback-controlled at the time of the warm-up fuel amount increase in the cold engine state, so that fluctuations and dispersion of the air-fuel ratio can be avoided.

Figure 14:
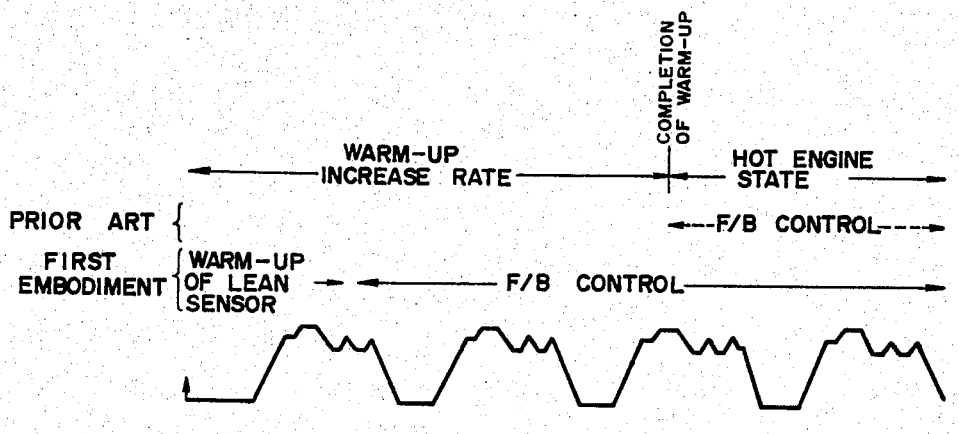
FIG. 14 is a graphic chart showing the comparison between examples of the feedback control regions at the time of a running mode tests including cold start in the prior art example and the first embodiment.

An example of the feedback control region of the exhaust gas at the time of a running mode tests including cold start in this embodiment is indicated by solid lines in FIG. 14. The feedback control can be started about four minutes earlier than the conventional feedback control region indicated by broken lines also in FIG. 14, so that the feedback control can be effected during the most part of the running mode. With this arrangement, the fluctuations in the air-fuel ratio, the disperson in the flowrate of the injectors and the like due to deteriotated components become correctable, whereby the exhaust gas purifying performance and the fuel consumption performance during the running mode tests are improved, and further, the drivablity is improved.

Detailed description will hereunder be given of the second embodiment of the present invention.

Figure 15:
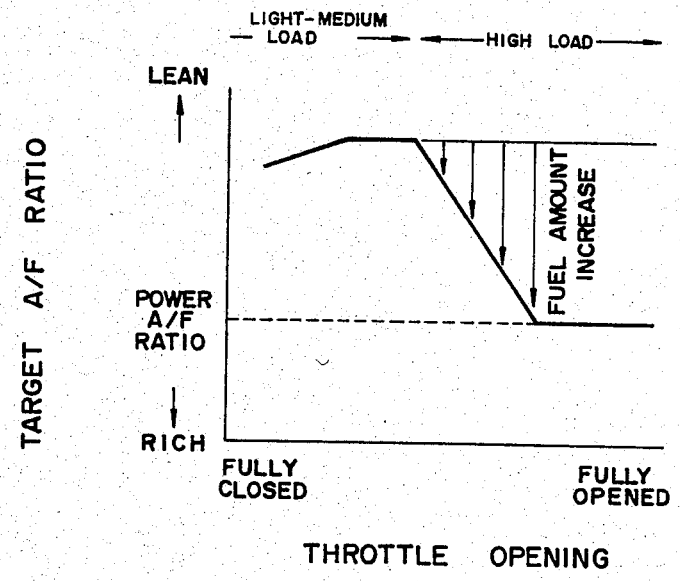
FIG. 15 is a graphic chart showing an example of the relationship between the throttle opening and the target air-fuel ratio in a second embodiment of the intake pipe pressure sensing type electronically controlled fuel injection device in an engine for a motor vehicle, to which the present invention is appled.

In this second embodiment, the present invention is applied to the electronically controlled fuel injection type engine, wherein in the low-medium load regions of the engine, the target air-fuel ratio is lean-controlled to improve the fuel consumption performance, whereas, in the high load region such a fuel amount increase is effected that the target air-fuel ratio is gradually varied from the base air-fuel ratio to the rich side in the high load region, in accordance with the throttle opening for example, as shown in FIG. 15, in order to set the air-fuel ratio to the power air-fuel ratio on the rich side to thereby improve the drivability, during the full opening of the throttle valve.

Figure 16:
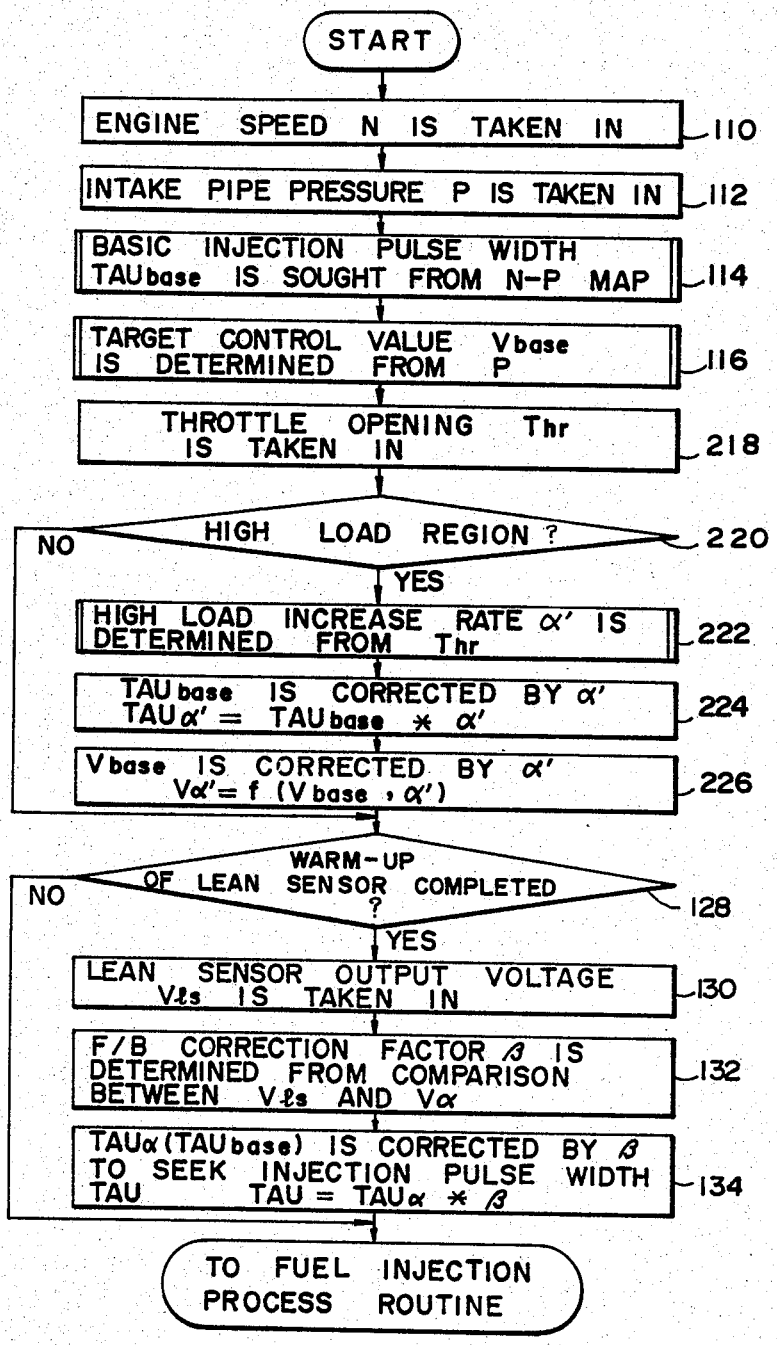
FIG. 16 is a flow chart showing the routine for determining the executing injection pulse width used in the second embodiment.

According to the second embodiment, in the electronically controlled fuel injection device in an engine for a motor vehicle, including the throttle body 22, the throttle valve 24, the throttle sensor 26, the surge tank 28, the pressure sensor 30, the intake manifold 32, the injectors 34, the spark plugs 36, the exhaust manifold 38, the ignition coil 40, the distributor 42, the crank angle sensor 44, the water temperature sensor 46, the ECU 48 and the like as shown in FIG. 5, the executing injection pulse width TAU is determined in the aforesaid ECU 48 in accordance with the flow chart shown in FIG. 16. Other respects are similar to those shown in the preceding first embodiment, so that the explanation thereof will be omitted.

The executing injection pulse width TAU is determined in this second embodiment in accordance with the flow chart as shown in FIG. 16. More specifically, upon completion of the same Steps 100 to 116 as shown in flow chart in FIG. 7, the routine proceeds to Step 218, where a throttle opening $T_{hr}$ is taken in in accordance with an output from the throttle sensor 26. Subsequently, the routine proceeds to Step 220, where it is examined whether the engine is in the high load region or not, from whether the throttle opening $T_{hr}$ is above a preset value or not. When the result of examination is positive, the routine proceeds to Step 222, where a high load increase rate $\alpha'(\alpha' \geqq 1.0)$ of fuel amount is determined in accordance with the throttle opening $T_{hr}$. Then, the routine proceeds to Step 224, where the basic injection pulse width $TAU_{base}$ is corrected by use of the obtained high load increase rate $\alpha'$ and in accordance with the following equation for example, to determine a corrected injection pulse width $TAU_{\alpha'}$.

$$TAU_{\alpha'} = TAU_{base} \times \alpha' \quad (4)$$

Subsequently, the routine proceeds to Step 226, where the target control voltage $V_{base}$ is corrected also by use of the high load increase rate $\alpha'$ and in accordance with the relationship shown in the following equation for example, to determine a corrected target control voltage $V_{\alpha'}$.

$$V_{\alpha'} = f(V_{base}, \alpha') \quad (b\ 5)$$

Upon completion of Step 226 or when the result of examination in the aforesaid Step 220 is negative, the routine proceeds to the same Step 128 as the flow chart of the first embodiment shown in the FIG. 7, where the Steps 128 to 134 are executed, and then, transfer is made to the known fuel injection process routine.

In this embodiment, the air-fuel ratio can be feedback-controlled at the time of the fuel increase in the engine high load region, so that the fluctuations and diversion of the air-fuel ratio can be prevented from occurring.

Additionally, the high load fuel amount increase in this second embodiment is executed only during the hot engine state, so that the second embodiment can be effected independently of the first embodiment. Further, it is possible to combine the first embodiment with the second embodiment.

In the above embodiments, the present invention has been applied when the target air-fuel ratio is varied to the rich side from the base air-fuel ratio by the fuel amount increase, however, the scope of the invention need not necessarily be limited to this, but the invention is applicable when the target air-fuel ratio is varied to the lean side from the base air-fuel ratio by the fuel amount decrease.

In the above embodiments, the feedback control has been effected irrespecitve of the relationship between the stoichiometric air-fuel ratio and the corrected target air-fuel ratio, however, the aforesaid feedback control can be effected only on the lean side from the stoichiometric air-fuel ratio and an open-loop control can be effected on the rich side because the detecting accuracy of the air-fuel ratio by the lean sensor is lowered on the rich side from the stoichiometric air-fuel ratio and not so high accuracy in the air-fuel control is required.

In the above embodiments, the present invention has been applied to the motor vehicle engine provided with the intake pipe pressure sensing type electronically controlled fuel injection device, however, the scope of the invention need not necessarily be limited to this, but, the invention is applicable to the motor vehicle engine provided with the intake air flowrate sensing type electronically controlled fuel injection device, and further, to the ordinary engines provided with the electronically controlled carbureter and the like.

It should be apparent to those skilled in the art that the above-described embodiments are merely representative, which represent the applications of the principles of the present invention. Numerous and varied other arrangements can be readily devised by those skilled in the art without departing from the spirit and the scope of the invention.

What is claimed is:

1. Method of lean-controlling an air-fuel ratio in an electronically controlled engine, wherein the air-fuel ratio is feedback-controlled to the lean side from the stoichiometric air-fuel ratio in accordance with an output from a lean sensor generating an output signal substantially proportional to the concentration of oxygen in exhaust gas, characterized in that said method comprises:

a step of determining a target control value of an output from said lean sensor corresponding to a base air-fuel ratio which is a target air-fuel ratio during normal engine operating condition, in accordance with the engine operating condition;

a step of examining whether the target air-fuel ratio is required to be varied to a ratio which is between the base air-fuel ratio and the stoichiometric air-fuel ratio or not, in accordance with the engine operating condition, a step correcting said target control value in accordance with the variation value of the target air-fuel ratio when said target air-fuel ratio is required to be varied; and a step of feedback-controlling the air-fuel ratio so that the output from said lean sensor can become the target control value.

2. Method of lean-controlling an air-fuel ratio in an electronically controlled engine as set forth in claim 1, wherein said target control value is corrected when said target air-fuel ratio is varied to the rich side from the base air-fuel ratio but still lean side from the stoichiometric ratio in accordance with the temperature of engine cooling water in a cold engine state.

3. Method of lean-controlling an air-fuel ratio in an electronically controlled engine as set forth in claim 2, wherein the cold engine state is determined from that the temperature of engine coolant is below a preset value.

4. Method of lean-controlling an air-fuel ratio in an electronically controlled engine as set forth in claim 1, wherein said target control value is corrected when the target air-fuel ratio is gradually varied to the rich side from the base air-fuel ratio but still lean side from the stoichiometric ratio in accordance with the throttle opening in a high engine load region.

5. Method of lean-controlling an air-fuel ratio in an electronically controlled engine as set forth in claim 4, wherein the high engine load region is determined from that the throttle opening is above a preset value.

6. Method of lean-controlling an air-fuel ratio in an electronically controlled engine as set forth in claim 1, wherein said feedback control is not effected before the completion of warm-up of said lean sensor.

7. System for lean-controlling an air-fuel ratio in an electronically controlled engine, comprising:

a pressure sensor for detecting intake air pressure;

an injector or injectors for intermittently injecting pressurized fuel into the engine;

a lean sensor for generating an output voltage substantially proportional to the concentration of oxygen in the exhaust gas;

a crank angle sensor for detecting the temperature of engine coolant; and an electronic control unit for calculating a basic injection pulse width in accordance with an engine load detected from an intake pipe pressure outputted from the pressure sensor and an engine speed obtained from the crank angle sensor, determining an executing injection pulse width by correcting the basic injection pulse width in accordance with at least outputs from the lean sensor and the coolant temperature sensor, feeding a valve opening period signal to the injector or injectors so that the injector or injectors can be intermittently opened for a valve opening period corresponding to the executing injection pulse width, feedback-controlling the air-fuel ratio so that the output from the lean sensor can become the target control value corresponding to the base air-fuel ratio during normal engine operating condition when the basic injection pulse width is corrected in accordance with the output from the lean sensor, and, feedback-controlling the air-fuel ratio so that the output from the lean sensor can become the target control value cor-rected to the rich side from the base air-fuel ratio but still lean side from the stoichiometric air-fuel ratio in accordance with the temperature of engine coolant in the cold engine state.

8. System for lean-controlling an air-fuel ratio in an electronically controlled engine, comprising:

a throttle sensor for detecting the opening of a throttle valve;

a pressure sensor for detecting intake air pressure;

an injector or injectors for intermittently injecting pressurized fuel into the engine;

a lean sensor for generating an output voltage substantially proportional to the concentration of oxygen in the exhaust gas;

a crank angle sensor for detecting a crank angle of the engine; and an electronic control unit for calculating a basic injection pulse width in accordance with an engine load detected from an intake pipe pressure outputted from the pressure sensor and an engine speed obtained from the crank angle sensor, determining an executing injection pulse width by correcting the basic injection pulse width in accordance with at least outputs from the throttle sensor and the lean sensor, feeding a valve opening period signal to the injector or injectors so that the injector or injectors can be intermittently opened for a valve opening period corresponding to the executing injection pulse width, feedback-controlling the air-fuel ratio so that the output from the lean sensor can become the target control value corresponding to the base air-fuel ratio during normal engine operating condition when the basic injection pulse width is corrected in accordance with the output from the lean sensor, and feedback-controlling the air-fuel ratio so that the output from the lean sensor can become the target control value gradually corrected to the rich side from the base air-fuel ratio but still lean side from the stoichometric air-fuel ratio in accordance with the throttle opening in the high engine load region.

* * * * *